United States Patent [19]

Schiemann

[11] Patent Number: 4,526,289

[45] Date of Patent: Jul. 2, 1985

[54] SCREW STOPPER FOR A CAN

[76] Inventor: Wolfram Schiemann,
Eugen-Nagle-Strasse 17, 7140
Ludwigsburg, Fed. Rep. of Germany

[21] Appl. No.: 633,719

[22] Filed: Jul. 24, 1984

[30] Foreign Application Priority Data

Aug. 5, 1983 [DE] Fed. Rep. of Germany ..... 3328320

[51] Int. Cl.[3] ..... B65D 53/00

[52] U.S. Cl. ..... 220/304; 220/375; 215/329

[58] Field of Search ..... 220/288, 304, 375; 215/329, 321, 330

[56] References Cited

U.S. PATENT DOCUMENTS

| | | | |
|---|---|---|---|
| 3,203,576 | 8/1965 | Wout et al. | 220/304 |
| 3,425,589 | 2/1969 | Lipske et al. | 220/304 |
| 3,841,514 | 10/1974 | Montgomery et al. | 215/329 |

*Primary Examiner*—George T. Hall

[57] ABSTRACT

Between a screw cap and pouring spout a snap device is formed in such a way that an acoustic signal is generated as soon as the seal between cap top and spout edge is compressed by a specific press stroke. Thus, both inadequate sealing pressing and overloading of the seal or threading are largely avoided.

8 Claims, 2 Drawing Figures

SCREW STOPPER FOR A CAN

The invention relates to a screw stopper for a can of synthetic plastics material for fuel, more particularly to a can of synthetic plastics material, comprising a pouring spout with external threads, a screw cap with internal threads screwable on the external threads of the pouring spout, and an elastically deformable seal arranged between the top of the screw cap and the edge of the pouring spout, wherein the cap top, after initial contact with the seal can be further pressed by an axial press stroke having a length exceeding which, the seal is irreversibly deformed or the engagement between internal and external threads is overloaded.

BACKGROUND OF THE INVENTION

Such screw stoppers are widespread in cans available on the market. Occasional complaints regarding escaping fuel indicate that in these cases the screw stopper was not correctly operated, and the seal was not able to carry out its function. Thus, for example, dirt in the threaded region can make the screwing on of the screw cap so difficult that the closure position is thereby simulated. Likewise, a closure position is simulated if the screw cap is screwed in a tilted position on to the pouring spout, in which case naturally the threading is partially damaged. Another fault consists in that the screw cap is screwed on with excessive force and then either the threading is so damaged that the screw cap can no longer be held correctly, or the seal is irreversibly deformed so that it can no longer carry out its function. The latter is to be expected predominantly in the case of seals of synthetic plastics material. Naturally, both kinds of damage can occur together.

OBJECT AND STATEMENT OF THE INVENTION

It is, therefore, the object of the invention to provide a screw stopper of the initially stated type in such a way that escape of fuel resulting from an inadequately firmly screwed-on screw cap is avoided as far as possible, but on the other hand damage due to excessive screwing on is likewise excluded as far as possible.

This object is achieved by the improvement wherein a snap device is provided between the screw cap and the pouring spout, in a manner such that on closure of the screw cap an acoustic signal is generated as soon as a predetermined spacing within the range of the length of the press stroke is reached between the cap top and the spout edge.

In accordance with the motto, "When it has clicked put it away", even less technically skilled users are to a certain extent instructed when the closure is correctly closed. Both an excessively slack seating of the screw cap and overloading of the components are thereby largely avoided. Advantageously, the invention includes the following additional features:

An axially overhanging cylinder wall on the end of the screw cap precedes the internal threads and has at least one radially inwardly directed dog in the region of the cylinder wall. An annular collar with a radially receding is on the pouring spout in the region remote from the spout edge, the cylinder wall reaching without appreciable deformation over the collar when the dog engages in the recess, the cylinder wall being elastically deformed at least in the region of the dog when the dog abuts on the collar outside the recess. This produces an especially expedient development of a snap device. About one-half turn before the final sealed position, the dog begins to slide up on to the collar, in which as a result of the screw principle, the distance component in the tangential direction amounts to a multiple of the pure axial component. Accordingly, the snap device is finely sensitive and precise.

The collar and dog have ramp flanks facing one another in order to facilitate axial sliding up of the dog on to the collar. The recess and the dog have ramp flanks facing one another in the engagement position in order to facilitate tangential sliding of the dog up on the collar upon the opening of the screw stopper. This serves so that the closure and opening of the screw stopper are hindered as little as possible.

The external threads and internal threads have a diameter of about 30 to 50 mm. with a pitch of about 5 mm. and extend axially over about 15 to 25 mm., and the collar extends radially about 2 mm. beyond the external threads and the collar and the cylinder wall have an axial extent of about 5 mm. The dog extends radially inwards about 1 to 2 mm., extends from the edge of the cylinder wall axially in the direction of the cap top about 2 to 6 mm. and is about 2 mm. long in the circumferential direction; and the recess at least somewhat exceeds these dog dimensions in depth, height and width. This indicates dimensioning data recognized to be especially expedient.

The seal is a sealing ring fixed in the region of the cap top. The sealing ring is comprised by rubber. This states an expedient further development with regard to the formation of the seal.

DESCRIPTION OF THE DRAWING

The invention will be explained in greater detail below by reference to an example of embodiment represented in the drawing, wherein.

DETAILED DESCRIPTION

Figure 1:
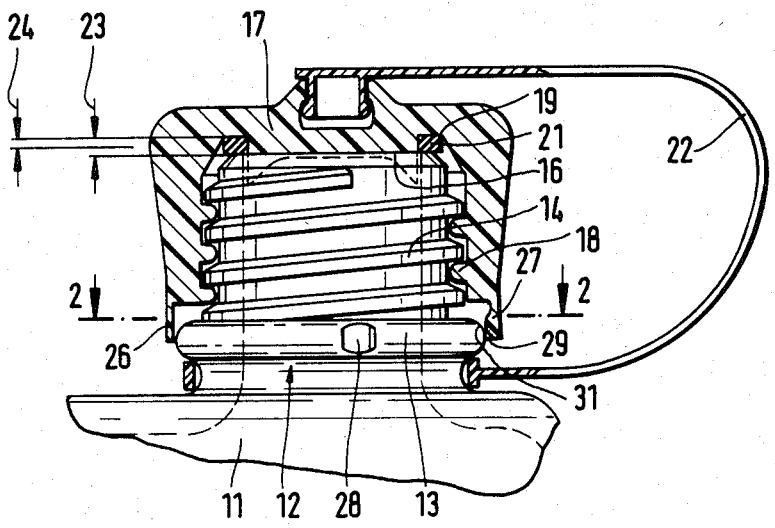
FIG. 1 shows a lateral elevation of a screw stopper according to the invention, partially in section.
Figure 2:
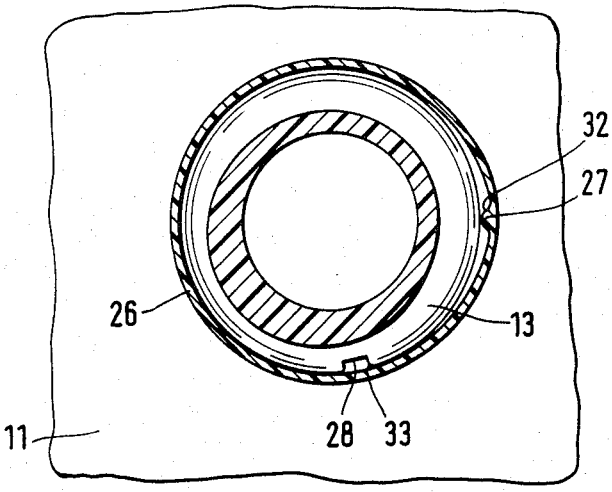
FIG. 2 shows a section in the plane 2—2 in FIG. 1.

A can 11 in known manner comprises a pouring spout 12 having a collar 13 and an external threading 14 reaching approximately to the edge 16 of the spout. The spout edge 16 is formed as a flat annular surface.

The screw stopper further comprises a screw cap 17 with a corresponding internal threading 18 and a seal 21 in the form of a sealing ring arranged between its cap top 19 and the spout edge 16.

The screw cap 17 is held on the can non-losably by means of a retaining strap fixed beneath the collar 13.

The position of the screw cap as represented in FIG. 1 corresponds to a position in which the seal 21 is just in contact with the spout edge 16. In this position the seal 21 has an axial extent 23 for example of 2 mm. By further closure screwing of the screw cap 17 the cap top 19 is applied further against the spout edge 16 by a press stroke 24 with simultaneous compression of the seal 21. Let it now be assumed that this press stroke can amount to about 1 mm., and on exceeding of this stroke either the engagement between internal threading 18 and external threading 14 is overloaded or the seal 21 is irreversibly deformed, so that it sacrifices its function. Thus it has to be ensured that the seal 21 on the one hand is compressed by approximately this press stroke 24, but on the other hand this press stroke 24 is not exceeded.

The constructional formation of the screw stopper as set forth hitherto corresponds to an embodiment known per se.

In order now to indicate to the user when this ideal seal condition is reached, the snap device as described in greater detail below is formed between the screw cap 17 and the pouring spout 12.

For this purpose on the end face of the screw cap 17 preceding the internal threading 18 an axially overhanging cylinder wall 26 is formed which comprises at least one radially inwardly directed dog 27. The collar 13 in this example of embodiment is present in any case, since it serves for the fixing of the retaining strap 22. Now however it also takes over an additional function. The sole modification on the can consists now in that this collar 13 is provided with a radially receding recess 28. It is understood that in the case of two opposite dogs, correspondingly two opposite recesses are also to be provided. Now the recess 28 is somewhat larger in its dimensions than the dog 27, so that the latter can enter it freely. The internal diameter of the cylinder wall 26 is adapted so that the cylinder wall reaches over the collar 13 without appreciable deformation when the dog 27 engages in the recess 28. However the cylinder wall 26 is elastically deformed at least in the region close to the dog 27 as long as the dog 27 abuts on the collar 13 outside the recess 28.

In the course of the closure of the screw stopper, about a half revolution to one revolution before the final closure position the dog 27 begins to slide up on to the collar 13 in a combined axial and tangential movement. This sliding is facilitated by the fact that the mutually facing surfaces are formed as wedge surfaces 29 and 31. As soon as approximately the limit of the permissible press stroke 24 is reached, the dog 27 snaps into the recess 28 and the part of the cylinder wall 26 deformed hitherto springs back into its relaxed rest position. The generation of a sufficiently loud snap noise is here promoted by the fact that the receding cylinder wall 26 strikes at least briefly against the collar 13, which then in turn transmits the vibration to the can 11 with its large sound radiation area.

In order to facilitate the sliding of the dog 27 on to the collar 13 in the opening of the screw stopper, the surfaces of dog 27 and recess 28 which face one another in the position of engagement have ramp flanks 32 and 33. Small roundings in this sense are to be regarded as equivalent to ramp flanks.

It is also to be pointed out that the snapping of the dog 27 into the recess 28 in a screw stopper of the classification in question is practically not effective in the sense of securing a closed position. In order correctly to close a can for fuel in fact a considerable press force has to be applied in the seal region and the resultant friction forces by far outweigh the possible retaining force of the snap device, so that the latter is practically insignificant.

In the example of embodiment the cylinder wall 26 is closed upon itself, whereby the advantage of greater insensitivity to destruction or deformation of this region of the screw cap is obtained. The illustration in the drawing is approximately to scale and as regards the dimensions typical for such a screw stopper.

I claim:

1. Screw stopper for a fuel can of synthetic plastic material, comprising a pouring spout with external threads, a screw cap with internal threads screwable on the external threads of the pouring spout, and an elastically deformable seal arranged between the top of the screw cap and the edge of the pouring spout, wherein the cap top, after initial contact with the seal can be further pressed by an axial press stroke having a length exceeding which, the seal is irreversibly deformed or the engagement between internal and external threads is overloaded; further comprising the improvement wherein a snap device is provided between the screw cap and the pouring spout, in a manner such that on closure of the screw cap an acoustic signal is generated as soon as a predetermined spacing, within the range of the length of the press stroke, is reached between the cap top and the spout edge.

2. Screw stopper according to claim 1, comprising an axially overhanging cylinder wall on the end of the screw cap preceding the internal threads, having at least one radially inwardly directed dog in the region of the cylinder wall; and an annular collar with a radially receding recess on the pouring spout in the region remote from the spout edge, the cylinder wall reaching without appreciable deformation over the collar when the dog engages in the recess, the cylinder wall being elastically deformed at least in the region of the dog when the dog abuts on the collar outside the recess.

3. Screw stopper according to claim 2, wherein the collar and dog have ramp flanks facing one another in order to facilitate axial sliding up of the dog on to the collar.

4. Screw stopper according to claim 2, wherein the recess and the dog have ramp flanks facing one another in the engagement position in order to facilitate tangential sliding of the dog up on the collar upon the opening of the screw stopper.

5. Screw stopper according to claim 1, wherein the external threads and internal threads have a diameter of about 30 to 50 mm. with a pitch of about 5 mm. and extend axially over about 15 to 25 mm., and the collar extends radially about 2 mm. beyond the external threads and the collar and the cylinder wall have an axial extent of about 5 mm.

6. Screw stopper according to one of claims 2 or 5 wherein the dog extends radially inwards about 1 to 2 mm., extends from the edge of the cylinder wall axially in the direction of the cap top about 2 to 5 mm. and is about 2 mm. long in the circumferential direction; and the recess at least somewhat exceeds these dog dimensions in depth, height and width.

7. Screw stopper according to claim 1, wherein the seal is a sealing ring fixed in the region of the cap top.

8. Screw stopper according to claim 7, wherein the sealing ring is comprised by rubber.

* * * * *